US009371210B2

(12) United States Patent
Parillo et al.

(10) Patent No.: US 9,371,210 B2
(45) Date of Patent: Jun. 21, 2016

(54) ELEVATOR SAFETY SYSTEM HAVING MULTIPLE BUSES

(75) Inventors: Shari R. Parillo, Berlin, CT (US); Paul C. Hoppie, Florence, SC (US); Steven D. Coste, Berlin, CT (US); Robert Mazzamauro, Meriden, CT (US); Ronnie E. Thebeau, Haddam, CT (US); Leslie C. Watterson, Unionville, CT (US); Peter Herkel, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 642 days.

(21) Appl. No.: 13/820,625

(22) PCT Filed: Sep. 13, 2010

(86) PCT No.: PCT/US2010/048627

§ 371 (c)(1),
(2), (4) Date: Apr. 5, 2013

(87) PCT Pub. No.: WO2012/036663

PCT Pub. Date: Mar. 22, 2012

(65) Prior Publication Data

US 2013/0192932 A1 Aug. 1, 2013

(51) Int. Cl.
*B66B 1/34* (2006.01)
*B66B 5/02* (2006.01)
(Continued)

(52) U.S. Cl.
CPC ... *B66B 5/02* (2013.01); *B66B 1/30* (2013.01); *B66B 1/3446* (2013.01); *B66B 5/0018* (2013.01)

(58) Field of Classification Search
CPC ..... B66B 1/30; B66B 1/3446; B66B 5/0018; B66B 5/02
USPC ..... 187/247, 277, 391, 393
See application file for complete search history.

(56) References Cited

U.S. PATENT DOCUMENTS 4,246,983 A * 1/1981 Bril ..... B66B 1/16 187/247
4,497,391 A 2/1985 Mendelsohn et al.
(Continued)

FOREIGN PATENT DOCUMENTS

CN 1342129 A 3/2002
CN 1549788 A 11/2004
(Continued)

OTHER PUBLICATIONS

Chinese Search Report for application CN 201080069074.0, dated Aug. 1, 2014, 2 pages.
(Continued)

*Primary Examiner* — Anthony Salata
(74) *Attorney, Agent, or Firm* — Cantor Colburn LLP

(57) ABSTRACT

An elevator safety system including a controller, and a hoistway safety node arranged at a pit portion of an elevator hoistway. The hoistway node is operatively connected to one of a pit safety device and a lower hoistway device arranged at the elevator pit. A first bus links the hoistway node and the controller. The first bus passes communication signals directly from the hoistway node to the controller. A car node is arranged in an elevator car. The car node is operatively connected to a car safety device arranged at the elevator car. A second bus links the car node and the controller. The second bus passes communication signals directly from the car node to the controller.

20 Claims, 1 Drawing Sheet

(51) Int. Cl.
*B66B 5/00* (2006.01)
*B66B 1/30* (2006.01)

(56) References Cited

U.S. PATENT DOCUMENTS

| | | | | |
|---|---|---|---|---|
| 4,872,532 | A | 10/1989 | Tobita et al. | |
| 4,958,707 | A | 9/1990 | Yoneda et al. | |
| 5,042,620 | A | 8/1991 | Yoneda et al. | |
| 5,387,769 | A * | 2/1995 | Kupersmith | G06F 11/1625 187/248 |
| 5,476,157 | A | 12/1995 | Todaro | |
| 5,854,454 | A | 12/1998 | Upender et al. | |
| 6,173,814 | B1 * | 1/2001 | Herkel | B66B 1/34 187/248 |
| 6,427,807 | B1 * | 8/2002 | Henneau | B66B 1/34 187/247 |
| 6,464,585 | B1 | 10/2002 | Miyamoto et al. | |
| 6,603,398 | B2 | 8/2003 | Tinone et al. | |
| 6,732,839 | B2 | 5/2004 | Schuster | |
| 7,178,635 | B2 | 2/2007 | Meissner et al. | |
| 7,252,180 | B2 | 8/2007 | Deplazes et al. | |
| 7,334,665 | B2 * | 2/2008 | Smith | B66B 1/34 187/247 |
| 7,849,975 | B2 * | 12/2010 | Ketonen | B66B 13/22 187/316 |
| 8,230,977 | B2 * | 7/2012 | Thumm | B66B 1/34 187/247 |
| 8,413,765 | B2 * | 4/2013 | Stratmann | B66B 5/0031 187/247 |
| 8,820,482 | B2 * | 9/2014 | De Coi | B66B 5/0031 187/247 |
| 8,899,383 | B2 * | 12/2014 | De Coi | B66B 13/22 187/247 |
| 8,959,405 | B2 * | 2/2015 | Ikawa | B66B 1/34 714/704 |
| 2013/0118836 | A1 * | 5/2013 | Rossignol | B66B 1/28 187/247 |
| 2013/0146399 | A1 * | 6/2013 | De Coi | B66B 13/22 187/393 |

FOREIGN PATENT DOCUMENTS

| | | | |
|---|---|---|---|
| EP | 1159218 | B1 | 7/2006 |
| JP | 2005500965 | A | 1/2005 |
| JP | 2006206245 | A | 8/2006 |
| JP | 2006315794 | A | 11/2006 |
| JP | 201095342 | A | 4/2010 |
| WO | 2012036663 | A1 | 3/2012 |

OTHER PUBLICATIONS

First Chinese Office Action translation for application CN 201080069074.0, mailed Aug. 8, 2014, 9 pages.
International Search Report and Written Opinion for PCT Application No. PCT/US2010/048627, dated Jun. 14, 2011, pp. 1-9.
International Search Report and Written Opinion for PCT Application No. PCT/US2010/048627, dated Mar. 28, 2013, pp. 1-6.
Japanese Office Action for JP Application No. 2013-528176, dated May 13, 2014, pp. 1-6.

* cited by examiner

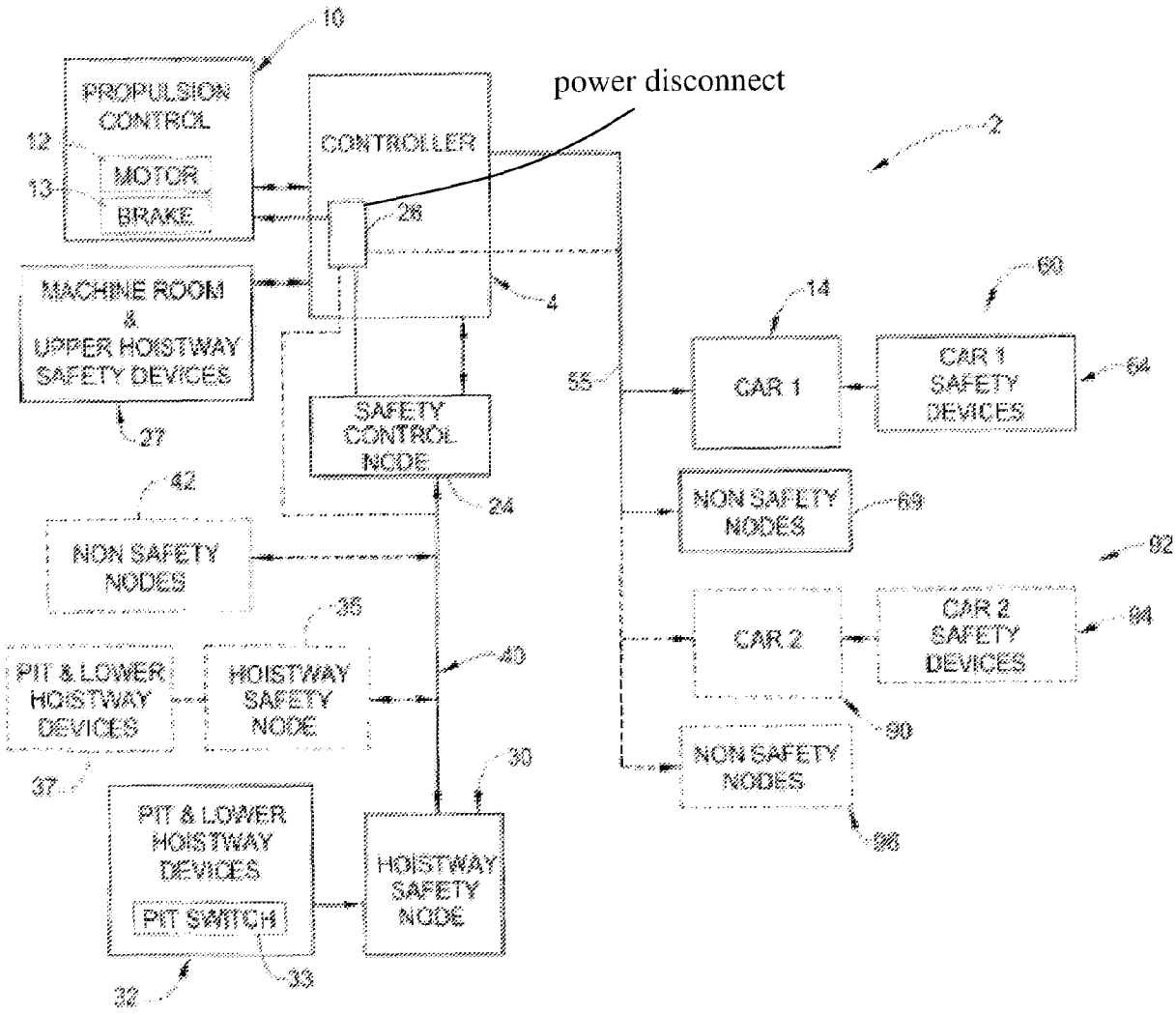
2
10
PROPULSION CONTROL
MOTOR
BRAKE
12
13
CONTROLLER
26
power disconnect
4
MACHINE ROOM & UPPER HOISTWAY SAFETY DEVICES
27
SAFETY CONTROL NODE
24
55
CAR 1
14
CAR 1 SAFETY DEVICES
60
64
NON SAFETY NODES
68
CAR 2
90
CAR 2 SAFETY DEVICES
84
92
NON SAFETY NODES
86
NON SAFETY NODES
42
HOISTWAY SAFETY NODE
36
40
HOISTWAY SAFETY NODE
30
PIT & LOWER HOISTWAY DEVICES
37
PIT & LOWER HOISTWAY DEVICES
PIT SWITCH
33
32

ELEVATOR SAFETY SYSTEM HAVING MULTIPLE BUSES

CROSS-REFERENCE TO RELATED APPLICATION

This application is a National Stage Application of PCT Application No. PCT/US10/048627, filed Sep. 13, 2010, the disclosure of which is incorporated by reference herein in its entirety.

BACKGROUND OF THE INVENTION

Exemplary embodiments pertain to the art of elevator systems and, more particularly, to a safety system for an elevator.

Elevators systems include a operational control and drive system (controller), motor, and brake that moves and stops elevator cars along a hoistway from just above a lower pit to an upper floor. The elevator system includes various safety devices typically arranged in a safety chain. The safety chain includes a number of safety devices whose output contacts are arranged in series. Some of safety devices are located near the elevator machine equipment, such as an over speed governor, while other devices such as switches and locks, are associated with elevator car doors, and still other devices are located in the hoistway, and pit. Typically the safety chain is linked to the control of power to the motor and brake. Activation of any device along the safety chain will cause the controller to disconnect the motor and brake from a main power supply. Power is required in order to lift the elevator brake. Therefore, activation of a safety device will apply the brake and remove power from the driving machine thus prohibiting motion of the elevator car.

Currently, the elevator system includes a controller located at or above the upper floor, typically in a mechanical room. Monitoring of the safety chain devices to facilitate repair or active bypass of a safety device to meet elevator safety codes requires discreet conductors that extend from each safety device in the safety chain to the controller. As such, a large number of wires extend to the controller from the pit along the hoistway, from the elevator car within a traveling cable, and often from intermediate floors.

BRIEF DESCRIPTION OF THE INVENTION

Disclosed is an elevator safety system including a controller, and a hoistway safety node arranged at a pit portion of an elevator hoistway. The hoistway node is operatively connected to one of a pit safety device and a lower hoistway device arranged at the elevator pit. A first bus links the hoistway node and the controller. The first bus passes communication signals directly from the hoistway node to the controller. A car node is arranged in an elevator car. The car node is operatively connected to a car safety device arranged at the elevator car. A second bus links the car node and the controller. The second bus passes communication signals directly from the car node to the controller.

Also disclosed is a method of communicating elevator safety information in an elevator system. The method includes collecting information from a safety device at a hoistway node arranged at an elevator pit, processing the information at the hoistway node into a communication signal, passing the communication signal from the hoistway node through a first bus directly to a controller, collecting additional information from a car safety device at a car node arranged in an elevator car, processing the additional information at the car node into another communication signal, and passing the another communication signal from the car node through a second bus directly to the controller.

BRIEF DESCRIPTION OF THE DRAWINGS

The following descriptions should not be considered limiting in any way. With reference to the accompanying drawings, like elements are numbered alike:

The FIGURE is a block diagram illustrating an elevator control system in accordance with an exemplary embodiment.

DETAILED DESCRIPTION OF THE INVENTION

A detailed description of one or more embodiments of the disclosed apparatus and method are presented herein by way of exemplification and not limitation with reference to the FIGURES.

An elevator control system in accordance with an exemplary embodiment is illustrated generally at 2 in FIG. 1. Elevator control system 2 includes a controller 4 that is operatively connected to a propulsion system 10. Propulsion system 10 includes a motor 12 that shifts an elevator car 14 along a hoistway (not shown) and a brake 13 for stopping elevator car 14. Controller 4 is also operatively connected to a safety control node 24. Safety node 24 includes a power disconnect 26 that is configured and disposed to sever power to propulsion system 20 in the event of a safety issue. Controller 4 activates propulsion system 10 to position elevator car 14 at a desired location along the hoistway while safety control node 24 monitors machine room and upper hoistway safety devices 27.

Elevator control system 2 includes a hoistway safety node 30 located at a lower or pit portion of the hoistway. Hoistway safety node 30 may be located in the hoistway, above the pit portion of the hoistway, or adjacent to the hoistway depending upon various construction requirements/constraints. Hoistway safety node 30 is linked to pit and lower hoistway devices 32 that include, for example, a pit switch 33 that allows maintenance personnel to de-activate propulsion system 10 during elevator maintenance. Pit and lower hoistway devices 32 may also include one or more of a pit inspection device; manual controls for moving the elevator at a slow controlled speed during service and maintenance operations, a lower hoistway access key, and controls for moving the elevator from a hall side of the hoistway to allow access to the pit area for service and maintenance. Pit sand lower hoistway devices 32 may further include switches required by a local code authority including, for example, buffer switches, a compensation sheave switch, a governor tension sheave switch, anti-rebound device Switch, and the like. It should be understood that elevator control system 2 could include additional hoistway safety nodes, such as shown at 35. Additional hoistway safety node 35 is linked to additional pit safety and lower hoistway devices 37 in a manner similar to that described above.

In accordance with an exemplary embodiment, hoistway safety node 30 is linked directly to controller 4 through a first bus 40. First bus 40 transmits communication signals that are processed at hoistway safety node 30 directly to controller 4. First bus 40 may also be linked to a non-safety node 42 that delivers non-safety related signals, such signals from floor buttons to controller 4. Controller 4 communicates a pre-flight check command to hoistway safety node 30 enabling a check of all safety signals prior to initiating a subsequent start of the elevator and also an optional command to turn on a feed to the lower access key switch. The phrase "linked directly"

should be understood to mean that communication signals passing though the first bus do not pass though any intervening nodes prior to reaching controller 4. In accordance with one aspect of the exemplary embodiment, first bus 40 is a serial bus, however, it should be understood that other types of communication buses can be employed.

In further accordance with the exemplary embodiment, elevator control system 2 includes a second bus 55 that directly links elevator car 14 with controller 4. More specifically, second bus 55 carries communication signals from a car safety node 60 that is linked to a car safety devices 64 which may include switches required by local code authority such as a car gate switch, safety operated switch, emergency escape switches, in-car emergency stop switches, door zone sensors, emergency terminal speed limiting device sensors, normal terminal stopping device sensors and the like. Communications may also include any pre-flight check commands to car node 60 enabling a check of all safety signals prior to the start of the next run of the elevator. In accordance with one aspect of the exemplary embodiment, buss 55 is also linked to a non-safety node 69 that may include car fixture electronics, a load weighing sensor, and a door controller. In accordance with another aspect of the exemplary embodiment, second bus 55 carries signals from a second elevator car 90 that is selectively moveable within the hoistway along with elevator car 14. In a manner similar to that described above, second bus 55 carries communication signals processed in a car safety node 92 to controller 4 and/or Propulsion system 10 and operational control system. Car safety node 92 includes car safety devices 94. Bus 55 may also connect with a non safety node 96 that includes, for example, car fixture electronics, a load weighing sensor, and/or a door status sensor.

In accordance with another aspect of the exemplary embodiment, in addition to communicating directly with controller 4, second bus 55 may be configured to link elevator car 14 directly to power disconnect 26. In this manner, any potential safety issues directly affect propulsion system 10 to control of elevator car 14. That is, in the event of a safety issue emanating from car node 60, second bus 55 can bypass controller 4 and directly signal propulsion system 10 to stop operation of elevator car 14.

In accordance with still another aspect of the exemplary embodiment, first bus 40 may be configured to directly link hoistway safety node 30 to power disconnect 26. In this manner, signals indicating a potential safety issue are sent directly to Propulsion system 10 to affect operation of elevator car 14 without requiring input or delay from controller 4. That is, in the event of a safety issue emanating from hoistway safety node 30, first bus 40 can bypass controller 4 and directly signal propulsion system 10 to stop operation of elevator car 14.

The direct link between the hoistway safety node, controller, and propulsion system reduces signal processing time for potential pit and/or lower hoistway safety related signals. In addition, the direct link minimizes the number and length of conductors passing though the hoistway and along the traveling cable. Similarly, the direct link between the elevator car, the controller, the propulsion system, and the operational control reduces signal processing time for potential car safety signals. In addition, the direct link reduces the number of conducted passing along the traveling cable. Minimizing the number of conductors on the traveling cable reduces weight of the overall system passing along the hoistway.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. An elevator safety system comprising:

a controller located at a single location;

a hoistway safety node arranged at a pit portion of an elevator hoistway, the hoistway node being operatively connected to one of a pit safety device and a lower hoistway device arranged at the elevator pit;

a first bus linking the hoistway node and the controller, the first bus passing communication signals from the hoistway node to the controller;

a car node arranged in an elevator car, the car node being operatively connected to a car safety device arranged at the elevator car; and a second bus linking the car node and the controller, the second bus passing communication signals from the car node to the controller.

2. The elevator safety system according to claim 1, further comprising: a propulsion system including a motor configured to shift the elevator car along an elevator hoistway and a brake configured and disposed to stop movement of the elevator car in the hoistway.

3. The elevator safety system according to claim 2, further comprising: a power disconnect operatively connected to the propulsion system.

4. The elevator safety system according to claim 3, wherein the first bus is linked to the propulsion system through the power disconnect, the hoistway node being configured and disposed to signal the power disconnect to de-activate the propulsion system in the event of a safety event.

5. The elevator safety system according to claim 3, wherein the second bus is linked to the propulsion system through the power disconnect, the car node being configured and disposed to signal the power disconnect to de-activate the propulsion system in the event of a safety event.

6. The elevator safety system according to claim 1, wherein the first bus is a serial bus.

7. The elevator safety system according to claim 1, wherein the second bus is a serial bus.

8. The elevator safety system according to claim 1, further comprising: another hoistway safety node arranged at a pit portion of an elevator hoistway, the another hoistway node being operatively connected to one of a pit safety device and a lower hoistway device arranged at the elevator pit.

9. A method of communicating elevator safety information in an elevator system, the method comprising:

collecting information from a safety device at a hoistway node arranged at an elevator pit;

processing the information at the hoistway node into a communication signal;

passing the communication signal from the hoistway node through a first bus to a controller located at a single location;

collecting additional information from a car safety device at a car node arranged in an elevator car;

processing the additional information at the car node into another communication signal; and passing the another communication signal from the car node through a second bus to the controller.

10. The method of claim 9, further comprising: passing information from at least one non safety node to the controller through the first bus.

11. The method of claim 9, further comprising: passing information from the hoistway node to a power disconnect operatively linked to a propulsion system.

12. The method of claim 9, further comprising:

sensing activation of a pit safety device; and establishing an interruption of power to the propulsion system from the hoistway node through the power disconnect in response to activation of the pit safety device.

13. The method of claim 9, further comprising: passing the additional information from the car node to a propulsion system of the elevator system through a power disconnect.

14. The method of claim 9, further comprising:

sensing activation of a car safety device; and establishing an interruption of power to the propulsion system from the car node through the power disconnect in response to activation of the car safety device.

15. The method of claim 9, wherein processing the information into a communication signal comprises processing the information into a serial communication signal.

16. The method of claim 9, wherein processing the additional information into a another communication signal comprises processing the information into a serial communication signal.

17. The method of claim 9, further comprising: collecting information from a safety device at another hoistway node arranged at the elevator pit.

18. The method of claim 17, further comprising: processing the information at the another hoistway node into a communication signal.

19. The method of claim 18, further comprising: passing the communication signal from the another hoistway node through the first bus to the controller.

20. The method of claim 9, further comprising:

collecting further information from car safety device at another car node arranged in another elevator car.

* * * * *